US011702267B2

(12) United States Patent
Surra

(10) Patent No.: US 11,702,267 B2
(45) Date of Patent: Jul. 18, 2023

(54) PACKAGING FOR THE SCRATCHPROOF TRANSPORTATION OF PHARMACEUTICAL BOTTLES

(71) Applicant: SOFFIERIA BERTOLINI S.P.A., Turin (IT)

(72) Inventor: Renato Surra, Turin (IT)

(73) Assignee: SOFFIERIA BERTOLINI S.P.A., Turin (IT)

( * ) Notice: Subject to any disclaimer, the term of this patent is extended or adjusted under 35 U.S.C. 154(b) by 222 days.

(21) Appl. No.: 17/274,301

(22) PCT Filed: Sep. 10, 2019

(86) PCT No.: PCT/IB2019/057622
§ 371 (c)(1),
(2) Date: Mar. 8, 2021

(87) PCT Pub. No.: WO2020/053762
PCT Pub. Date: Mar. 19, 2020

(65) Prior Publication Data

US 2021/0331852 A1 Oct. 28, 2021

(30) Foreign Application Priority Data

Sep. 11, 2018 (IT) ..... 102018000008492

(51) Int. Cl.
*B65D 77/04* (2006.01)

(52) U.S. Cl.
CPC .... *B65D 77/0446* (2013.01); *B65D 2577/043* (2013.01)

(58) Field of Classification Search
CPC ..... B65D 77/044; B65D 77/0433; B65D 77/0426; B65D 77/042; B65D 77/0413;
(Continued)

(56) References Cited

U.S. PATENT DOCUMENTS 3,743,088 A * 7/1973 Henkin ..... A61B 5/00 422/503
3,828,906 A * 8/1974 Schellhorn ..... G07F 11/62 194/235
(Continued)

FOREIGN PATENT DOCUMENTS

CN 102 897 414 1/2013
DE 82 08 634 6/1984
(Continued)

*Primary Examiner* — Kareen K Thomas
(74) *Attorney, Agent, or Firm* — Leason Ellis LLP

(57) ABSTRACT

A packaging for the stocking and transportation of glass bottles including a box closed on five sides and open at the top, configured to house a plurality of bottles therein, arranged side-by-side in a vertical position, and a lid couplable in a removable manner with the box, in a position facing a bottom wall of the box; wherein the lid is provided, on a face thereof configured to be facing, in use, the bottom wall, with a plurality of spacer elements, which protrude in a cantilever fashion from the face of the lid and towards the bottom wall of the box; the spacer elements being configured to be interposed, in use, between each bottle contained in the box and respective other bottles immediately adjacent thereto and/or between some bottles and a side wall of the box.

9 Claims, 3 Drawing Sheets

(58) Field of Classification Search
CPC .... B65D 77/0406; B65D 77/04; B65D 77/02; B65D 77/006; B65D 77/003; B65D 77/0446; B65D 2577/043; B65D 2577/04; B65D 2577/041; B65D 2577/042
See application file for complete search history.

(56) References Cited

U.S. PATENT DOCUMENTS 4,635,795 A * 1/1987 DeFlander ..... B65D 5/322 229/160
5,060,804 A * 10/1991 Beales ..... B65D 77/28 229/103.1
5,080,224 A * 1/1992 Kuhn ..... B65D 5/5019 206/434
5,369,939 A * 12/1994 Moen ..... B65B 7/285 53/376.5
5,437,363 A * 8/1995 Gungner ..... B65D 71/32 206/196
5,655,705 A * 8/1997 Bates ..... B65D 71/38 229/117.16
5,830,548 A * 11/1998 Andersen ..... B28B 11/008 428/152
8,955,682 B2 * 2/2015 Lecheval ..... B65D 71/38 206/779
10,618,717 B2 * 4/2020 Kneisel ..... B01L 9/06
2005/0175338 A1 * 8/2005 Ide ..... G03D 3/06 396/647
2011/0277419 A1 * 11/2011 Nicoletti ..... B65D 77/2024 53/167

FOREIGN PATENT DOCUMENTS

EP 2 659 922 11/2013
GB 2 478 703 9/2011
WO WO 2010/086128 8/2010

* cited by examiner

PACKAGING FOR THE SCRATCHPROOF TRANSPORTATION OF PHARMACEUTICAL BOTTLES

CROSS-REFERENCE TO RELATED APPLICATIONS

This patent application is a U.S. National Phase Application under 35 U.S.C. § 371 of International Patent Application No. PCT/IB2019/057622, filed on Sep. 10, 2019, which claims priority from Italian patent application no. 102018000008492, filed on Sep. 11, 2018, all of which are incorporated by reference, as if expressly set forth in their respective entireties herein.

TECHNICAL FIELD OF THE INVENTION

The present invention relates to packaging for the in-line stocking and transportation of bottles, especially but not exclusively for pharmaceutical use.

The term "packaging" refers, here and in the following, to a closed container formed by at least two elements or components that can be coupled to one another. The term "in-line" instead refers, here and in the following, to the fact that at least one of the components of the packaging is adapted to be used immediately downstream of a production plant for the glass bottles and/or of a silicon coating line thereof.

PRIOR ART

It is known that glass bottles and/or glass vials for pharmaceutical use are produced from a glass tube, which is cut and shaped into the desired shape by flame. The bottles or vials thus obtained are subjected to a stress relieving heat treatment and, subsequently, are also subjected to a silicone coating treatment, by means of which the bottles or vials are internally siliconized, i.e. their inner surface is coated with a thin layer of liquid silicone, at the end of the production steps, successively baked to ensure perfect adhesion to the walls of the bottle.

Immediately after the silicone coating or, in any case, immediately after baking the silicone layer, the bottles (or vials) are arranged vertically and with a slight clearance between one another, almost in contact with one another, inside a rectangular box, with their respective inlets facing upwards. This box is used to carry out further handling and the transport to the place of use.

However, when the glass bottles come into contact with each other during the handling of the box, they produce noise and above all the outer surface thereof can be damaged (with the formation of scratches) or even they may break. This produces unwanted waste that greatly increases production costs and can lead to returns of the bottles to the manufacturer from the customers.

SUMMARY OF THE INVENTION

The object of the present invention is to provide a packaging for the scratchproof in-line stocking and transportation of glass bottles (or vials), especially but not exclusively for pharmaceutical use, preferably immediately downstream of the production step, which can be easily handled, of low cost, simple to produce and which, at the same time, avoids any noise and/or damage to the bottles/vials.

Therefore, according to the invention, a packaging is provided for the scratchproof in-line stocking and transportation of glass bottles (or vials), especially but not exclusively for pharmaceutical use, having the characteristics disclosed in the attached claims.

BRIEF DESCRIPTION OF THE DRAWINGS

Further characteristics and advantages of the present invention will become clearer from the following description of a non-limiting embodiment thereof, made with reference to the Figures of the attached drawings, wherein.

DETAILED DESCRIPTION

Figure 1:
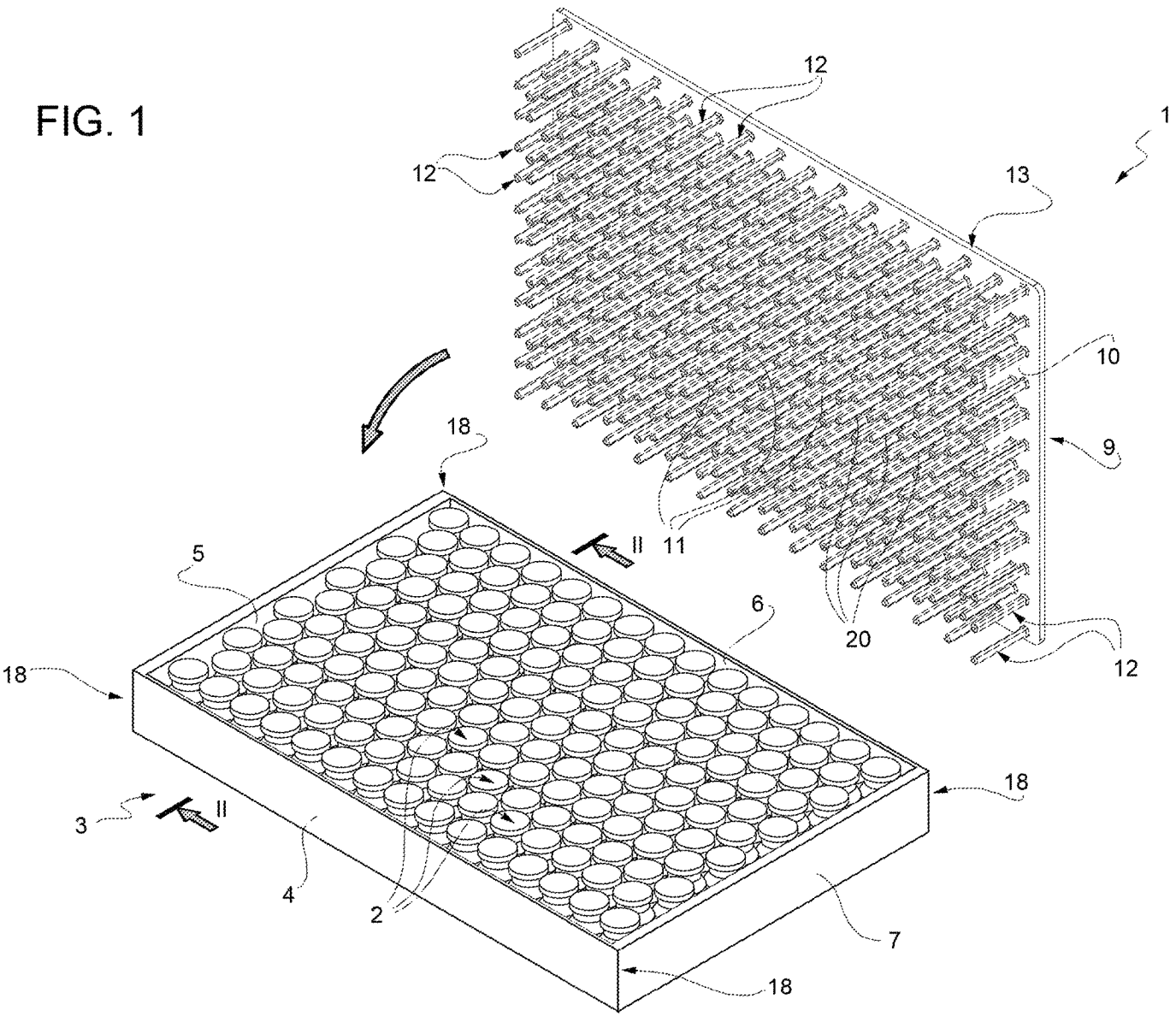
FIG. 1 schematically illustrates the packaging according to the invention in an exploded configuration and filled with glass bottles for pharmaceutical use.

With reference to Figures from 1 to 5, number 1 denotes, as a whole, a packaging for the in-line stocking and transportation of glass bottles 2, especially but not exclusively for pharmaceutical use.

In the non-limiting embodiment illustrated, the packaging 1 is intended to receive bottles or "vials" 2 for pharmaceutical use, of a known type, but it is clear that the packaging 1 of the invention, that will be described, can receive other types of glass containers, for example vials, so the term "bottle" should not be referred to in a limitative sense here and in the following.

The packaging 1 comprises a box 3 closed on five sides and open at the top, configured to house a plurality of bottles 2 therein, arranged neatly side-by-side in a vertical position.

Figure 3:
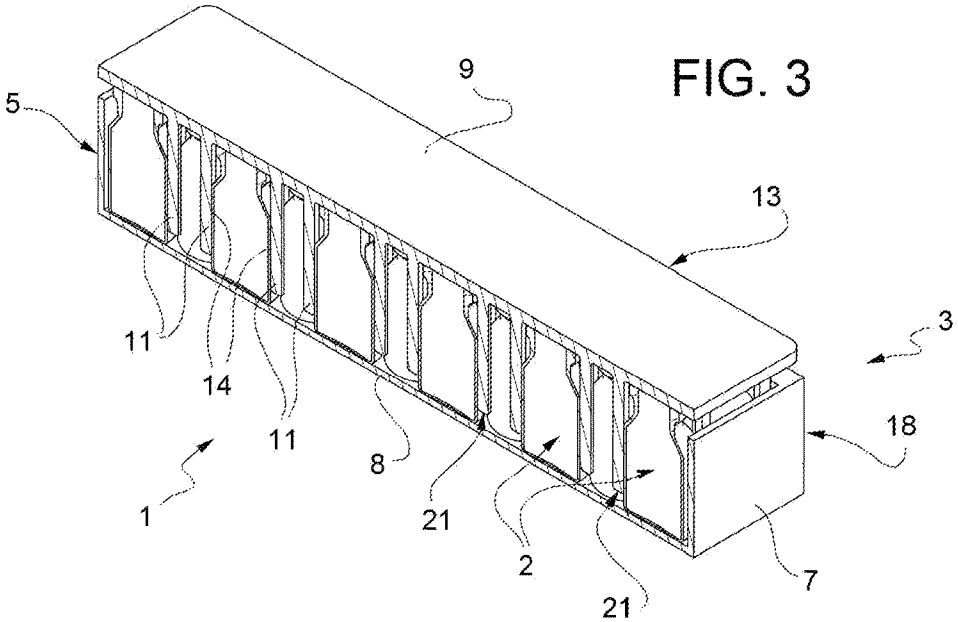
FIG. 3 illustrates a schematic axonometric sectioned view (again according to the trace plane II-II) of the packaging of FIGS. 1 and 2 filled with bottles.
Figure 2:
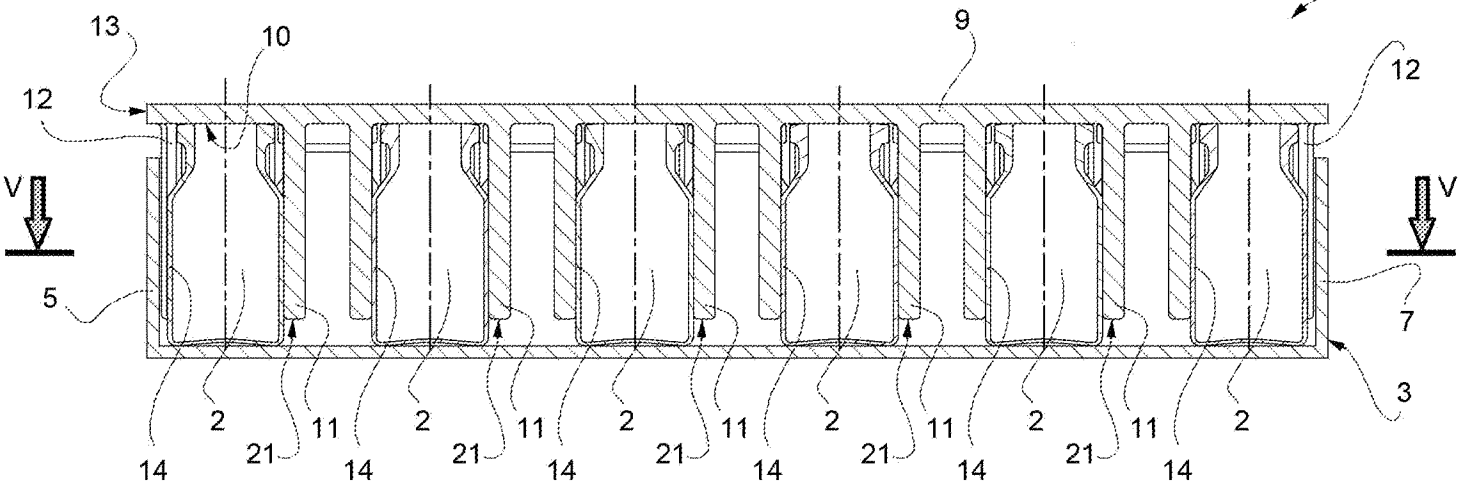
FIG. 2 schematically illustrates, on an enlarged scale, an elevated and sectioned view according to a trace plane II-II of the packaging of FIG. 1 in a use configuration.

In the non-limiting, but preferred embodiment of the invention illustrated herein, the box 3 is a parallelepiped-shaped box and is delimited by four side walls 4, 5, 6 and 7, arranged, two-by-two, adjacent and perpendicular to each other, and by a flat bottom wall 8 (not shown in FIG. 1 but shown in FIGS. 2 and 3). The box 3 can be made, by moulding, in a synthetic plastic material, or it can also be metal, for example obtained by shearing and folding a metal sheet.

The packaging 1 further comprises a lid 9 couplable in a removable manner with the box 3, in a position facing the bottom wall 8 of the box, to close the box 3 itself at the top.

According to a first characteristic of the invention, the lid 9 is provided, on a first face 10 thereof, configured to be turned in use towards the bottom wall 8 of the box, with a plurality of first spacer elements 11 and second spacer elements 12, which project in a cantilever fashion from said face 10 of the lid 9 and towards the bottom wall 8 of the box 3.

Figure 4:
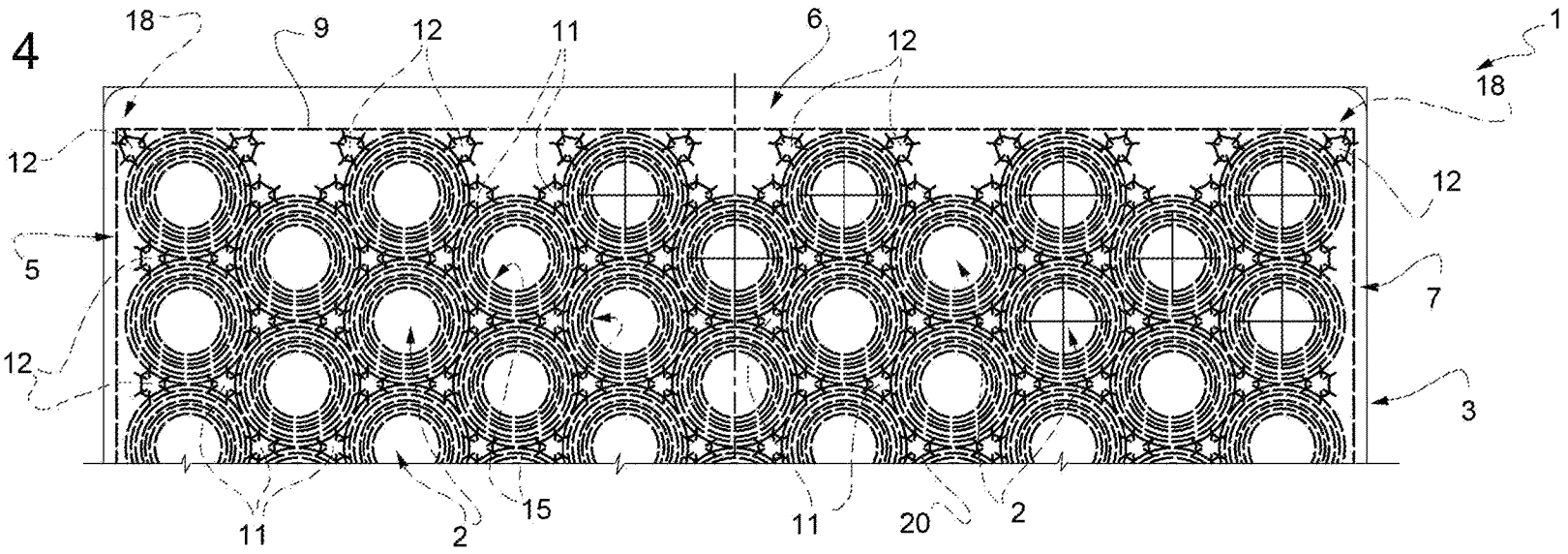
FIG. 4 illustrates a schematic plan view from above of the packaging of FIGS. 1 and 2.
Figure 5:
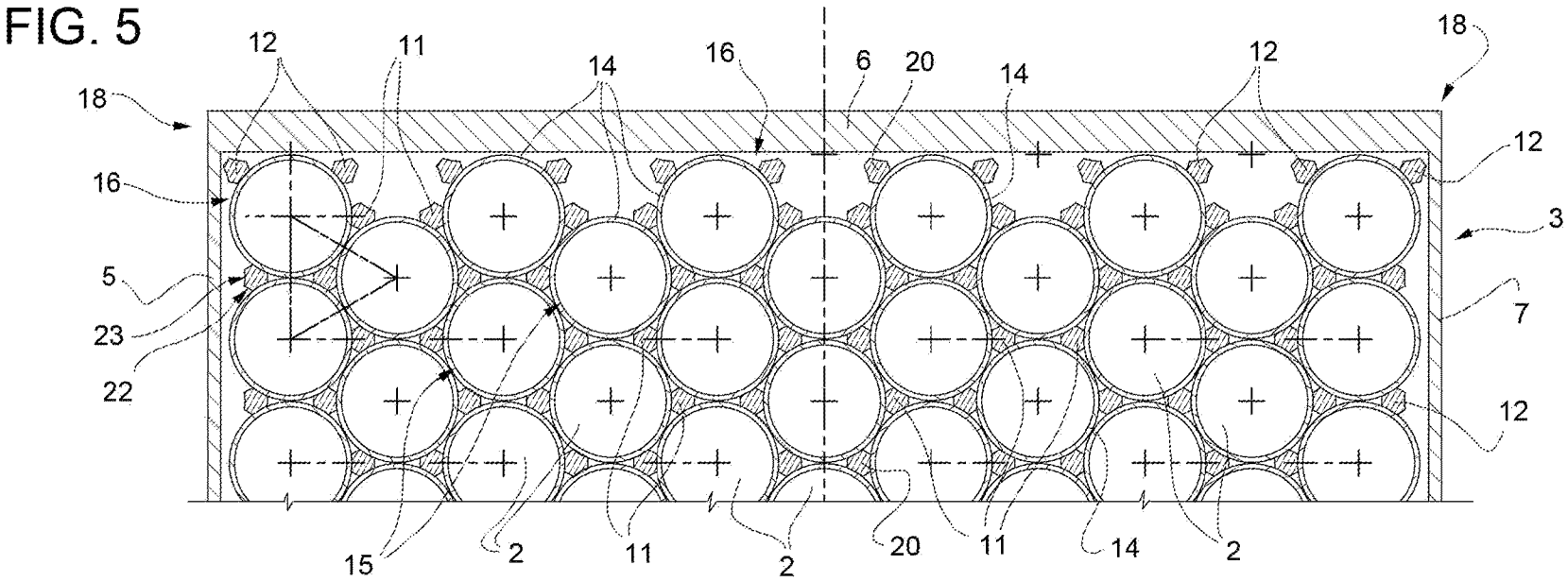
FIG. 5 schematically illustrates a plan view, sectioned according to a trace plane V-V, of the packaging according to the invention filled with glass bottles.

According to the invention, the first spacer elements 11 are configured to be interposed, in use, between each bottle 2 contained in the box 3 and respective other bottles 2 immediately adjacent thereto (FIGS. 4 and 5).

The second spacer elements 12 are arranged near a peripheral edge 13 of the lid 9 and are configured to be interposed between the bottles 2 and a respective side wall 4, 5, 6, 7 of the box depending on which of these is adjacent to the bottles 2 arranged peripherally in the box 3.

According to another aspect of the invention, at least some of the second spacer elements 12 are also configured to cooperate with at least two of the side walls 4-7, in this case with the walls 4 and 6 arranged opposite and facing each other, to guide the lid 9 to couple correctly with the box 3.

In the illustrated and preferred embodiment, the packaging 1 is configured to contain glass bottles 2 each being delimited by a cylindrical side wall 14.

In this case, the first spacer elements 11 are preferably arranged on the lid 9 forming hexagonal assemblies 15 (FIGS. 4 and 5); in particular, in each hexagonal assembly 15, each spacer element 11 is arranged according to the vertexes of a hexagon and simultaneously is part of both its hexagonal assembly 15 under consideration, and of other two hexagonal assemblies 15 immediately adjacent to the previous one.

The second spacer elements 12 are instead arranged on the lid 9 so as to form part of respective peripheral hexagonal assemblies 16 (FIG. 5), at least partly incomplete, formed also in part by some of the first spacer elements 11.

The peripheral hexagonal assemblies 16 are arranged immediately adjacent to the side walls 4-7.

Moreover, at least some of the second spacer elements 12 cooperate with respective joining corners 18 of the box 3 arranged between two side walls 5,6 or 6,7 or 7,4 or 4,5 in order to form guides for the coupling of the lid 9 with the box 3.

The spacer elements 11 and 12 are formed, according to a preferred aspect of the invention, by straight pegs 20 that extend in a cantilever fashion from the face 10 of the lid 9 perpendicular to the lid 9 itself; the face 10, as well as to the bottom wall 8 already described, is flat.

The spacer elements 11 and 12 and the lid 9 are preferably made of a synthetic plastic material, and the spacer elements 11, 12 are formed integral in one piece with the lid 9, having been moulded with the same by means of a single moulding operation, e.g. by injection moulding. For example, lid 9 and pegs 20 are made of a synthetic silicone plastic resin, or of PE, PP or another suitable synthetic plastic material.

Moreover, the first and second spacer elements 11 and 12 are preferably made with an identical shape and size and differ from one another only by the relative position on the lid 9.

Finally, according to the non-limiting embodiment illustrated, the spacer elements 11,12 are formed by straight pegs 20, which extend in a cantilever fashion from the first face 10 of the lid 9 perpendicular to the lid itself, and which have a constant cross-section or, at the most, tapered towards a free end 21 of the pegs 20.

The cross-section of each peg 20 preferably has a polygonal shape, even more preferably a pentagonal shape, and is delimited (FIG. 5) by sides adjacent two-by-two, alternately a straight one 22 and a curved one 23, for each pair of adjacent sides 22,23.

Finally, the length of the pegs 20 is sized so that the free ends 21 of the pegs 20 remain spaced from the bottom wall 8 of the box 3 when the lid 9 is coupled to the box 3, so as not to create unwanted interference due to the machining tolerances.

Once the processing of the bottles 2 is finished, they are stored in a box 3 directly on the processing line; possibly the box 3 can also be used to carry out the baking step of the inner silicone layer with which the side walls 14 are coated, with the bottles 2 already housed in the box 3, for example if the latter is made of metal or in any case of a heat resistant material.

Subsequently, the lid 9 is brought closer to and fitted onto the box 3 for example as shown by the arrow in FIG. 1. The pegs 20 are inserted in the interstices between the bottles 2, which are housed in the box 3 in a position adjacent to one another but with a minimum radial clearance and, at the same time, cooperate, at least at the corners 18, with at least two opposite side walls, for example 6 and 4 of the box 3 to guide the lid 9 and the respective pegs 20 in order to be inserted correctly in the box 3 and between the bottles 2, respectively.

Once the lid 9 is coupled with the box 3, the packaging 1 takes on the appearance illustrated in FIGS. 2-4, wherein the pegs 20 forming the spacer elements 11 are interposed between all the bottles 2 adjacent to one another, while the pegs 20 forming the spacer elements 12 are interposed between the bottles 2, housed peripherally in the box 3, and the side walls 4-7.

In this way, the bottles 2 cannot collide with each other, with the side walls 14, or against the side walls 4-7 of the box 3 and therefore they can neither break nor be damaged superficially, especially if lid 9 and pegs 20 are made with a soft and at least partially elastic synthetic plastic resin, such as a silicone resin.

The production cost of the lid 9 is then negligible, once the cost of the moulds is recuperated, and the assembly on the box 3 is quite simple and easy.

Optionally, snap fastening means (not illustrated for simplicity) to the box 3 can also be provided on the lid 9.

All the aims of the invention are therefore achieved.

The invention claimed is:

1. A packaging (1) for the in-line stocking and transportation of glass bottles (2), especially but not exclusively for pharmaceutical use, comprising a box (3) closed on five sides and open at the top, configured to internally house a plurality of bottles (2) arranged side-by-side in a vertical position, and a lid (9) couplable in a removable manner with said box (3), in a position facing a bottom wall (8) of said box, for closing the box at the top; wherein the lid (9) is provided on a first face (10) thereof, configured to be facing in use the bottom wall (8) of the box, with a plurality of first (11) and second (12) spacer elements, which protrude in a cantilever fashion from said first face (10) of the lid and towards the bottom wall of the box, said first spacer elements (11) being configured to be interposed, in use, between each bottle (2) contained in the box and respective other bottles (2) immediately adjacent thereto; and wherein said second spacer elements are arranged close to a peripheral edge of said lid and are configured to be interposed between the bottles and a respective side wall of the box.

2. The packaging according to claim 1, characterised in that said box (3) is a parallelepiped-shaped box delimited by four side walls (4,5,6,7) and by a bottom wall (8); and in that at least some of said second spacer elements (12) are also configured to cooperate with at least two (4,6) of said side walls opposite to and facing each other, for guiding said lid (9) to correctly couple itself with said box (3).

3. The packaging according to claim 1, characterised in that it is configured to contain glass bottles (2) each being delimited by a cylindrical side wall (14); said first spacer elements (11) being arranged on said lid (9) forming hexagonal assemblies (15); in each hexagonal assembly (15), each spacer element (11) being arranged according to the vertexes of a hexagon and simultaneously forming part of both its hexagonal assembly and of other two immediately adjacent hexagonal assemblies (15).

4. The packaging according to claim 3, characterised in that said second spacer elements (12) are arranged on the lid so as to form part of respective peripheral assemblies (16) only approximately hexagonal being at least partly uncomplete, formed also in part by some of said first spacer elements (11), said peripheral assemblies (16) being arranged immediately adjacent to said side walls (4,5,6,7).

5. The packaging according to claim 4, characterised in that at least some of said second spacer elements (12) cooperate with respective joining corners (18) of the box (3) arranged between two immediately adjacent side walls (5,6; 6,7; 7,4; 4,5).

6. The packaging according to claim 1, characterised in that said spacer elements (11, 12) are formed by straight pegs (20) that extend in a cantilever fashion from said first face (10) of the lid (3), perpendicular to the lid itself; said first face (10) being flat.

7. The packaging according to claim 1, characterised in that said spacer elements (11, 12) and said lid (9) are made of a synthetic plastic material, the spacer elements (11, 12) being integral in one piece with the lid (9).

8. The packaging according to claim 1, characterised in that said first and said second spacer elements (11, 12) have identical shapes and sizes.

9. The packaging according to claim 1, characterised in that said first and said second spacer elements (11, 12) are formed by straight pegs (20) which extend in a cantilever fashion from said first face (10) of the lid, perpendicular to the lid itself; said pegs (20) having a constant transversal section or, at the most, tapered towards a free end (21) of the pegs; said transversal section of each peg having a polygonal shape, preferably a pentagonal shape, and being delimited by sides (22, 23) arranged adjacent two-by-two, alternatively one straight and one curved for each pair of adjacent sides; the length of said pegs (20) being sized so that said free ends (21) of the pegs remain spaced apart from the bottom wall (8) of the box with the lid coupled to the box.

* * * * *